United States Patent [19]

De Clercq

[11] Patent Number: 4,610,122

[45] Date of Patent: Sep. 9, 1986

[54] CONCRETE REINFORCING ROD HOLDER

[76] Inventor: Marcel D. De Clercq, 20,235 Sunnyside, St. Clair Shores, Mich. 48080

[21] Appl. No.: 792,534

[22] Filed: Oct. 29, 1985

Related U.S. Application Data

[63] Continuation-in-part of Ser. No. 660,012, Oct. 11, 1984.

[51] Int. Cl.[4] ..... E04C 5/20

[52] U.S. Cl. ..... 52/719; 24/339; 52/686; 403/400

[58] Field of Search ..... 52/719, 685, 686; 24/339, 336; 403/400

[56] References Cited

U.S. PATENT DOCUMENTS

| | | | |
|---|---|---|---|
| 3,360,883 | 1/1968 | Glanzer | 24/339 X |
| 3,673,753 | 7/1972 | Anderson | 52/686 X |
| 3,778,537 | 12/1973 | Miller | 24/339 X |
| 3,863,416 | 2/1975 | Oroschakoff | 52/719 X |
| 4,131,258 | 12/1978 | Okuda et al. | 24/339 X |
| 4,302,124 | 11/1981 | Wilks et al. | 403/400 X |
| 4,440,519 | 4/1984 | Pennel | 403/400 |

FOREIGN PATENT DOCUMENTS

| | | | |
|---|---|---|---|
| 2405209 | 8/1974 | Fed. Rep. of Germany | 52/678 |
| 960508 | 4/1950 | France | 24/339 |
| 1078290 | 8/1967 | United Kingdom | 52/686 |

*Primary Examiner*—Alfred C. Perham
*Attorney, Agent, or Firm*—William L. Fisher

[57] ABSTRACT

Improvement in a concrete reinforcing rod holder comprising hollow open-sided sections joined together so as to hold a pair of contacting reinforcing rods prior to pouring concrete to form a reinforced concrete structure, such improvement comprising each such section having a substantially uniform wall thickness and a cavity having inner and outer portions formed therein, the center of the inner portion of such cavity being located so as to coincide with the center of the respective reinforcing rod held therein and the center of the outer portion thereof being radially offset inwardly of that of such inner portion.

5 Claims, 5 Drawing Figures

CONCRETE REINFORCING ROD HOLDER

This application is a continuation-in-part of application Ser. No. 660,012 filed Oct. 11, 1984.

My invention relates to reinforced concrete and has for its principal object the provision of novel concrete reinforcing-rod holders which serve to quickly join reinforcing rods together and securely hold them together during the process of pouring concrete.

Present practice involves joining reinforcing rod wiring them together which is time consuming and does not always produce a secure hold.

The foregoing object of my invention and the advantages thereof will become apparent during the course of the following description, taken in conjunction with the accompanying drawings, in which.

Figure 1:
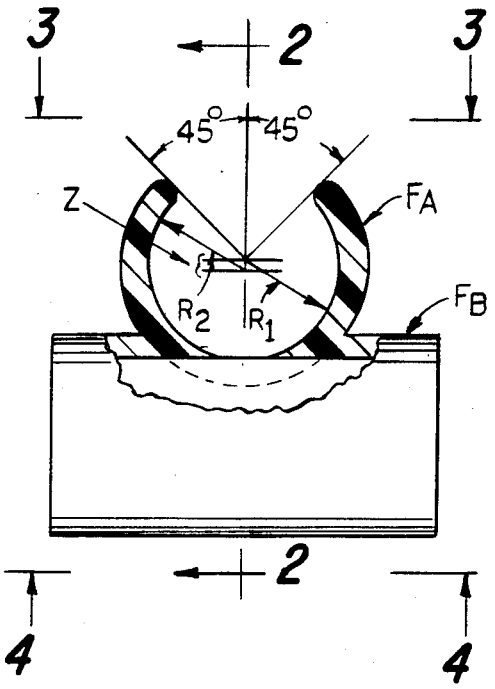
FIGS. 1 and 2 are opposite elevational views, with parts in section, of a concrete reinforcing rod holder embodying my invention.
Figure 1A:
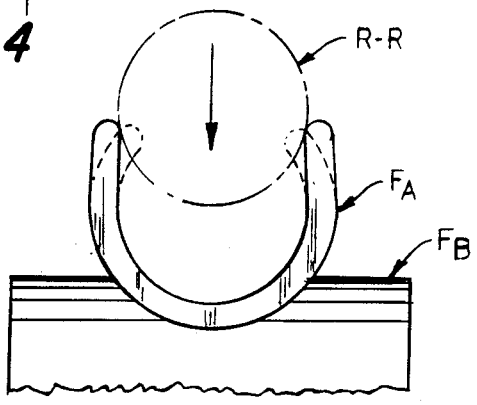
FIG. 1A is a fragmentary view similar to FIG. 1 showing a concrete reinforcing rod being inserted into a cavity of said reinforcing rod holder.
Figure 2:
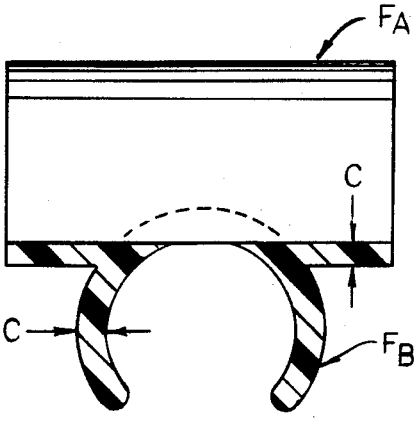
Figure 3:
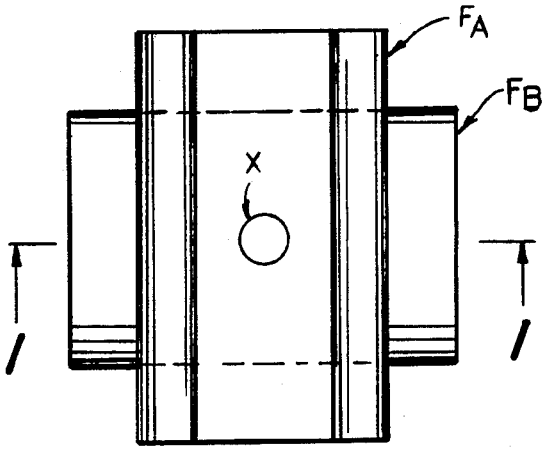
FIGS. 3 and 4 are top and bottom plan views, respectively, of the structure of FIG. 1.
Figure 4:
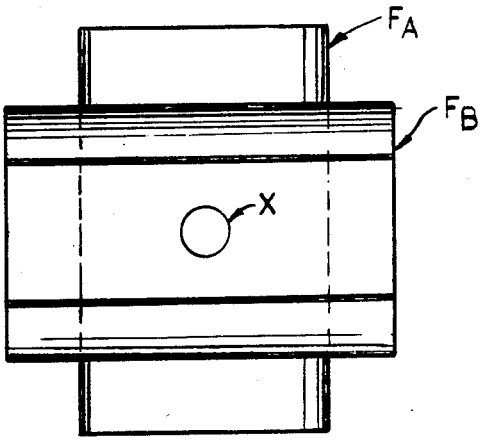

Referring to the drawings in greater detail, $F_A$ and $F_B$ designate permanently joined elements or sections, respectively, of said reinforcing rod-holder with I herewith designate, DeClercq's "GRIPOD" holder, which term I wish used whenever reference is made thereto. Said sections $F_A$ and $F_B$ are open sided, hollow and generally pipe shaped which adapts them to be fabricated of suitable plastic or resin. Said reinforcing-rod holder can be fabricated so that the sections $F_A$ and $F_B$ are formed simultaneously in one integral assembly, preferably by injection molding. The wall thickness of the section $F_A$ is identical to that of section $F_B$ and each such wall thickness is designated C. The sections $F_A$ and $F_B$ have a single common aperture formed during the injection molding process in their common wall, as shown and indicated at X. To better hold reinforcing rods R—R in DeClerq's "GRIPROD" holder, each part $F_A$ or $F_B$ is formed with a cavity having differentially centered inside radii, as shown, in order to tighten the grip of said "GRIPROD" holder on the reinforcing rod R—R held therein. What is shown in FIG. 1 for the section $F_A$ applies also to section $F_B$; the center of the inner portion $R_1$ of said cavity coincides with the center of the reinforcing rod R—R held therein. The center of the outer portion $R_2$ is disposed radially inwardly of said first-mentioned center by a distance Z equal to $\frac{1}{2}$C; the distance Z being measured along that central diameter which bisects the open end of said cavity, as shown. The length of each part $F_A$,$F_B$ is approximately four times that the length of either of said differential radii.

In use of DeClerq's "GRIPROD" holder, one section (either $F_A$ or $F_B$) is snapped over a reinforcing-rod and then a criss-crossing reinforcing-rod is snapped into the other section ($F_A$ or $F_B$ respectively). The two reinforcing-rods held in DeClerq's "GRIPROD" holder substantially touch at their common point of tangency at the center of the common aperture X formed through the respective floors of the sections $F_A$ and $F_B$. In any given application, as many of DeClerq's "GRIPROD" holders are used as there are criss-crossing reinforcing rods needed to be joined together prior to the pouring of the particular concrete structure to be formed. The plurality of DeClerq's "GRIPROD" holders form and hold the system of criss-crossing reinforcing-rods into a rigid framework ready to receive the poured concrete. When the concrete is poured, each DeClerq "GRIPROD" holder becomes embedded in the concrete with the reinforcing rods.

The inner portion $R_1$ of the cavity of each part $F_A$ or $F_B$ extends over an arc of approximately 180 degrees, while the outer portion $R_2$ extends over approximately 90 degrees. Thus, the outer portion $R_2$ of such cavity is permanently formed tighter closed than the inner portion $R_1$, whereby to increase the force of grip on the reinforcing rod R—R held therein. Insertion of a reinforcing rod R—R into such cavity spreads apart the sides of the outer portion $R_2$ thereof, as shown in FIG. $1_A$, and the tendency of such outer portion $R_2$ to return to its normal relaxed position enhances the grip on said reinforcing rod R—R. Whenever mention is made herein of inserting a reinforcing rod R—R into a cavity in a "Griprod" reinforcing rod holder, it is to be understood that relative insertion is meant. Thus if a reinforcing rod R—R is held stationary while the "Griprod" reinforcing rod holder is moved into locking engagement therewith, it is considered the same as though the "Griprod" reinforcing rod holder is held stationary while the reinforcing rod R—R is inserted thereinto.

It will thus be seen that there has been provided by my invention, novel concrete reinforcing rod holders in which the object hereinafter set forth, together with many thoroughly practical advantages, has been successfully achieved. While preferred embodiments of my invention have been shown and described, it is to be understood that variations and changes may be resorted to without departing from the spirit of my invention as defined by the appended claims.

What I claim is:

1. Improvement in a concrete reinforcing rod holder comprising hollow open-sided sections joined together so as to hold a pair of contacting reinforcing rods prior to pouring concrete to form a reinforced concrete structure, said improvement comprising each said section having a substantially uniform wall thickness and a cavity having inner and outer portions formed therein, the center of the inner portion of said cavity being located so as to coincide with the center of the respective reinforcing rod held therein and the center of the outer portion thereof being radially offset inwardly of that of said inner portion.

2. Improvement in a concrete reinforcing rod holder as claimed in claim 1 in which said radial offset is along a central diameter which makes a 45 degree angle with an outside edge of said cavity.

3. Improvement as claimed in claim 2 in which said radial offset is equal to one-half of said wall thickness.

4. Improvement as claimed in claim 1 in which there are two sections disposed at right angles to each other so as to hold a pair of criss-crossed reinforcing rods.

5. Improvement as claimed in claim 1 in which said sections mutually intersect and form a through aperture through the common wall between them, the pair of reinforcing rods held in said holder contacting each other through said aperture.

* * * * *